US011419378B2

(12) United States Patent
Thiel

(10) Patent No.: US 11,419,378 B2
(45) **Date of Patent: *Aug. 23, 2022**

(54) HEADGEAR

(71) Applicant: MIPS AB, Täby (SE)

(72) Inventor: Johan Thiel, Täby (SE)

(73) Assignee: MIPS AB

( * ) Notice: Subject to any disclaimer, the term of this patent is extended or adjusted under 35 U.S.C. 154(b) by 343 days.

This patent is subject to a terminal disclaimer.

(21) Appl. No.: 16/796,874

(22) Filed: Feb. 20, 2020

(65) Prior Publication Data

US 2020/0187584 A1 Jun. 18, 2020

Related U.S. Application Data

(63) Continuation of application No. 15/548,819, filed as application No. PCT/EP2016/052735 on Feb. 9, 2016, now Pat. No. 10,602,794.

(30) Foreign Application Priority Data

Feb. 9, 2015 (GB) ..... 1502104

(51) Int. Cl.

| | |
|---|---|
| ***A42B 3/06*** | (2006.01) |
| ***A42B 3/10*** | (2006.01) |
| ***A42B 1/08*** | (2006.01) |
| ***A42B 3/12*** | (2006.01) |
| ***A42B 3/28*** | (2006.01) |
| ***A63B 71/10*** | (2006.01) |

(52) U.S. Cl.

CPC ..... *A42B 3/064* (2013.01); *A42B 1/08* (2013.01); *A42B 3/10* (2013.01); *A42B 3/127* (2013.01); *A42B 3/283* (2013.01); *A63B 71/10* (2013.01)

(58) Field of Classification Search

CPC .. A42B 3/064; A42B 3/10; A42B 1/08; A42B 3/127; A63B 71/10

See application file for complete search history.

(56) References Cited

U.S. PATENT DOCUMENTS

| | | | |
|---|---|---|---|
| 4,307,471 | A | 12/1981 | Lovell |
| 4,571,960 | A | 2/1986 | Hursh et al. |
| 5,204,998 | A | 4/1993 | Liu |
| 6,103,641 | A | 8/2000 | Gehring, Jr. |
| 6,108,820 | A | 8/2000 | Bernhardt |
| 6,658,671 | B1 | 12/2003 | Von Holst et al. |
| 8,613,114 | B1 | 12/2013 | Olivares Velasco |
| 8,732,868 | B2 | 5/2014 | Ellis |

(Continued)

FOREIGN PATENT DOCUMENTS

| | | |
|---|---|---|
| JP | 2003-518203 | 6/2003 |
| JP | 3184505 | 7/2013 |

(Continued)

OTHER PUBLICATIONS

PCT Application No. PCT/EP2016/052735, International Search Report and Written Opinion, dated May 12, 2016, 13 pages.

*Primary Examiner* — Tajash D Patel
(74) *Attorney, Agent, or Firm* — Perkins Coie LLP

(57) ABSTRACT

A hat, headband or helmet formed from a material (10) comprising first and second layers (11, 12) of material and a low friction interface (13) arranged between the layers to enable sliding of the first layer of material (11) relative to the second layer of material (12).

14 Claims, 2 Drawing Sheets

(56) References Cited

U.S. PATENT DOCUMENTS

| | | | | |
|---|---|---|---|---|
| 8,863,319 | B2 | 10/2014 | Knight | |
| 9,723,889 | B2 * | 8/2017 | Knight | A42B 3/12 |
| 10,463,099 | B2 * | 11/2019 | Allen | A42B 3/283 |
| 10,602,794 | B2 * | 3/2020 | Thiel | A42B 3/283 |
| 2003/0168118 | A1 | 9/2003 | Metzger | |
| 2004/0250340 | A1 | 12/2004 | Piper | |
| 2011/0167532 | A1 | 7/2011 | Carlson | |
| 2012/0297526 | A1 | 11/2012 | Leon | |
| 2013/0040521 | A1 | 2/2013 | Cuculo et al. | |
| 2013/0040524 | A1 | 2/2013 | Halldin | |
| 2014/0331391 | A1 | 11/2014 | Storelli | |
| 2017/0290388 | A1 | 10/2017 | Briggs | |
| 2018/0317589 | A1 | 11/2018 | Estas | |
| 2019/0029357 | A1 | 1/2019 | Bochner | |
| 2019/0254377 | A1 | 8/2019 | Briggs | |
| 2020/0187583 | A1 * | 6/2020 | Allen | A63B 71/10 |
| 2021/0378342 | A1 * | 12/2021 | Kirshon | A42B 3/121 |

FOREIGN PATENT DOCUMENTS

| | | | |
|---|---|---|---|
| NO | 1996014768 | A1 | 5/1996 |
| RU | 36947 | | 4/2004 |
| WO | WO 2004/032659 | | 4/2004 |
| WO | WO 2010/039524 | | 4/2010 |
| WO | WO 2011/087435 | | 7/2011 |
| WO | WO 2012/177552 | | 12/2012 |

* cited by examiner

HEADGEAR

This application is a continuation of U.S. application Ser. No. 15/548,819, filed Aug. 4, 2017, which is a 35 U.S.C. § 371 application of International Application No. PCT/EP2016/052735, filed Feb. 9, 2016, which claims the benefit of British Application No. 1502104.1, filed Feb. 9, 2015, each of which applications is incorporated by reference in its entirety.

The present invention relates to apparel, in particular headgear such as hats, headbands and helmets formed using materials including fabrics and textiles. In this context, it should be understood that material used to form such apparel may generally be provided in sheet-like forms and may be formed in a variety of ways. For example, material formed from natural or synthetic threads or yarns may be formed by processes including weaving, knitting, crocheting. Other materials may be formed, for example by a felt making process. Other methods may also be used to form material that can be used to form apparel, for example synthetic materials that may be directly formed in appropriately thin and flexible sheets to be used as material without proceeding via an intermediate stage of being formed into fibres.

Previously, a variety of materials, such as fabrics and cloths have been known for use in forming apparel such as hats, headbands and helmets. The present invention uses a new form of material for this use and provides new apparel that takes advantage of the properties of the new material.

According to the present invention, there is provided a hat or a headband formed from a material comprising:

first and second layers of material; and a low friction interface arranged between the layers to enable sliding of the first layer of material relative to the second layer of material.

According to the present invention, such a hat or a headband may be configured such that it may be worn inside a helmet.

According to the present invention, there is provided a kit comprising a helmet and such a hat or headband.

According to the present invention, there is provided a helmet, comprising a liner formed from a material comprising:

first and second layers of material; and a low friction interface arranged between the layers to enable sliding of the first layer of material relative to the second layer of material.

At least one of the first and second layers of material may be formed from a material that is at least one of a textile, a cloth and a fabric.

The low friction interface may configured such that, under loading that may be expected for apparel being worn by a wearer, the first layer of material may slide relative to the second layer of material. For example, the material may be suitable for use in the formation of apparel intended to provide protection to a wearer during an impact. For such use, the low friction interface may be configured such that, during an impact that is expected to be survivable for the wearer, the first layer of material may slide relative to the second layer of material.

The material may be manufactured and then used in the forming of an item of apparel. Alternatively or additionally, the material may be formed from its constituent parts at the same time as an item of apparel including the material is formed.

The invention will now be described by way of non-limiting examples, with reference to the accompanying drawings, in which.

As discussed above, the present invention uses a composite material formed from a plurality of layers in the formation of apparel including hats, headbands and helmets. The composite or layered material may be provided pre-prepared, for example in rolls or bales, for example to be cut to the required shape and, where necessary, have edges joined to each other or to other components in order to form apparel. Alternatively, as discussed further below the parts of the layered material may be provided separately and assembled together at the same time as forming the apparel or parts thereof.

The material is formed from first and second layers of material and a low friction interface arranged between the layers such that sliding of the first layer of material relative to the second layer of material is enabled.

The first and second layers of material may, for example, be formed from a textile, a cloth and/or a fabric. However, other materials may also be used, including felts and directly-formed flexible sheet materials including, for example, artificial leather.

It should be appreciated that the first and second layers of the material may be different and/or different types. Accordingly, where the material is used to form an item of apparel, the layer of material to be provided on the inside of the apparel may be selected for one particular quality, such as comfort for the wearer, while a second material may be selected for the layer to be formed on the outside of the apparel, for example for its appearance. Both layers may be formed from the same material.

However, many materials used to form items of apparel have relatively high coefficients of friction and there may be a relatively high coefficient of friction between two layers of different material that are selected for properties that are generally desirable for apparel. In the present invention a low friction interface is arranged between the first and second layers of material, enabling sliding between the first and second layers of material. As discussed below, this property may be useful when forming some items of apparel.

Figure 1:
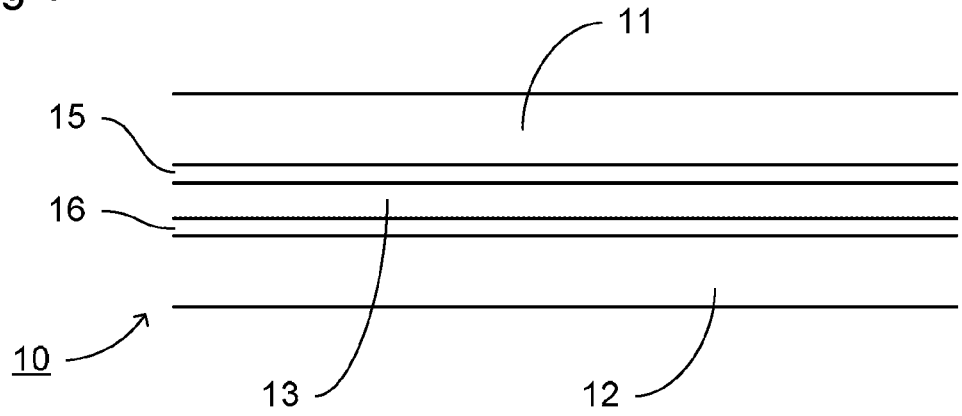
FIG. 1 depicts a cross-section of a portion of a material for use in the present invention.

FIG. 1 depicts an example of a material provided with a low friction interface. As shown, the material 10 includes first and second layers of material 11, 12 that may be, for example, a textile, cloth and/or fabric. In order to provide the low friction interface, a third layer of material 13 is provided between the first and second layers of material 11, 12. The third layer of material 13 may not be visible to the wearer of apparel formed from the material 10. Accordingly, the third layer of material 13 need not be selected for qualities that may usually be desirable for material used to form apparel. The third layer of material 13 may be selected in order to have low friction between the third layer of material 13 and at least one of the first and second layers of material 11, 12 at the respective interface 15, 16 between the third layer of material 13 and the first and/or second layer of material 11, 12. Such an arrangement enables sliding between the first and second layers of material 11, 12.

It should be appreciated that, for clarity, in FIG. 1 a separation is shown between the first, second and third layers of material 11, 12, 13, namely at the interfaces 15, 16. In practice these layers may be touching, at least in some regions of the material 10, especially in use.

Figure 2:
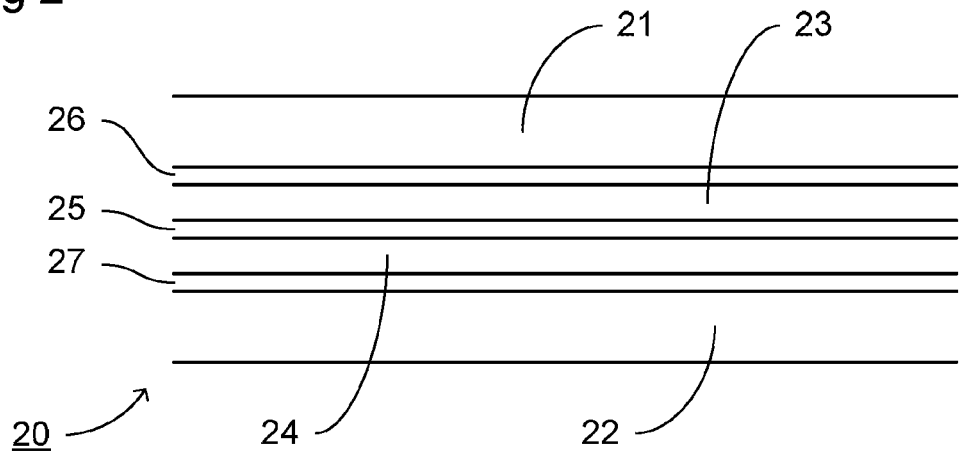
FIG. 2 depicts a cross-section of a portion of a material for use in the present invention.

FIG. 2 depicts an alternative arrangement of a material according to the invention. As with the arrangement depicted in FIG. 1, the material 20 includes first and second layers of material 21, 22. In this arrangement, the low friction interface is formed from third and fourth layers of material 23, 24 provided between the first and second layers of material 21, 22. In such an arrangement, the third and fourth layers of material 23, 24 may be selected for the low friction between the third and fourth layers of material 23, 24, namely at the interface 25 between them. Alternatively and/or additionally, the interface 26 between the first and third layers of material 21, 23 and/or the interface 27 between the second and fourth layers of material 22, 24 may be low friction.

In an arrangement such as that shown in FIG. 2, the third and fourth layers of material 23, 24 may be formed from the same substance or may be formed from different substances. Further layers of material may also be included, either to further promote sliding between any adjacent pair of layers and/or to provide additional properties to the material overall.

In the arrangements shown in FIG. 1 and FIG. 2 and discussed above, the third layer of material and the fourth layer of material, where used, may be formed from any suitable substance. For example these layers may be formed from films of plastic that may be formed to have smooth surfaces. It should also be appreciated that the arrangements depicted in the Figures are schematic and, accordingly, the relative thicknesses of the different layers shown in the figures may not be representative.

Figure 3:
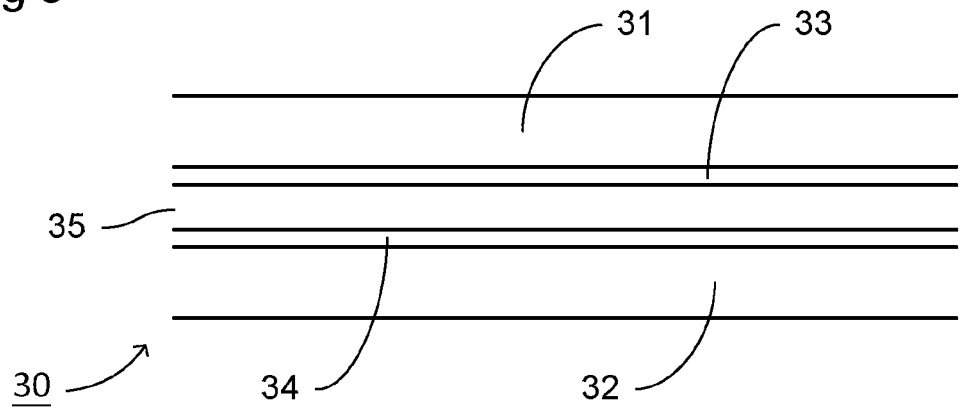
FIG. 3 depicts a cross-section of a portion of a material for use in the present invention.

FIG. 3 depicts a further arrangement for providing a low friction interface to the material. As before, the material 30 is formed from first and second layers of material 31, 32. In this arrangement, the low friction interface is formed by modifying the surface of at least one of the first and second layers 31, 32. The friction at the interface 35 in between the modified surface 33 of the first layer of material 31 and the modified surface 34 of the second layer of material 32 may be lower than the friction that would occur between the unmodified surfaces of the first and second layers of material 31, 32.

Depending on the modified surface, it may be sufficient that the surface of only one of the first and second layers of material be modified.

It should be appreciated that this arrangement may be combined with those discussed above, namely by providing one or more additional layers of material between the modified surfaces 33, 34 of the first and second layers of material 31, 32 in order to promote further the low friction interface.

It should also be appreciated that instead of modifying the surfaces of first and/or second layers of material 31, 32, the first and/or second layers of material may be selected such that there is sufficiently low friction between the opposing surfaces of the layers of material 31, 32 to provide a low friction interface.

A variety of modifications may be used in order to modify the surfaces 33, 34 of the first and/or second layers of material 31, 32. It should also be appreciated that a different modification may be used for the first layer of material 31 from the modification used for the second layer of material 32. By way of example, the surface of a layer of material may be modified by impregnating a different substance into the surface of the material. Alternatively or additionally, a different substance may be bonded to the surface of the layer of material. Alternatively or additionally, a physical treatment may be applied to the surface of the layer of material. For example, in the case of a woven synthetic material, the surface to be modified may be partially melted in order to provide a smoother surface.

In the preceding description, reference has been made to the provision of a low friction interface. It should be appreciated that the level of friction necessary to constitute low friction may vary. However, in this context, it is meant a level of friction between the first and second layers of material that ensures that the first layer of material may slide relative to the second layer of material under the loading that may be expected for apparel formed form the material when it is being worn by a wearer of the apparel. As is discussed further below, some apparel that may use this material may be intended to provide protection to a wearer during an impact. For that use of the material, the low friction interface may be configured such that the first layer of material may slide relative to the second layer of material during an impact that would be expected to be survivable for the wearer of the apparel formed using the material. In some uses of the invention, it may be desirable to configure the low friction interface such that the coefficient of friction is between 0.001 and 0.3 and/or below 0.15.

Although the above description has referred to the first and second layers of material as if they are a single substance, it should be appreciated that these layers of material may themselves may be formed from multiple constituents. For example, the first and/or second layer of material may include or may be attached to a layer of padding.

Furthermore, although FIGS. 1 to 3 depict portions of the material that are solid, in practice, the material may include perforations and/or air holes, for example to permit ventilation, depending on the use of the material.

In an example, at least one of the materials used to form the first and second layers may be stretchable. This may enable a region of one of the first and second layers of the material to slide relative to the other of the first and second layers, even if the edges of the first and second layers are secured relative to each other, for example, where a section of the material is secured to another component, for example, another part of an item of apparel in which the material is used. In such a condition, a part of one of the layers of material may be stretched on one side of the region that is sliding.

It has previously been identified that apparel, including helmets, provided to protect wearers from injury during an impact may be less effective than is desirable in the event of an oblique impact. During an oblique impact tangential force components may be exerted on the wearer. In the case of an oblique impact on a wearer's head, this may result in angular acceleration of the head. Angular acceleration of the head causes the brain to rotate within the skull, creating injuries on bodily elements connecting the brain to the skull and also to the brain itself.

Examples of rotational injury include subdural haematomas, bleeding as a consequence of blood vessels rupturing, and diffuse axonal injuries, which can be summarised as nerve fibres being overstretched as a consequence of high shear deformations in the brain tissue. Dependent on the characteristics of the rotational force, such as the duration, amplitude and rate of increase, either subdural haematomas or diffuse axonal injuries occur, or a combination of these is suffered. Generally speaking, subdural haematomas occur in the case of short duration and great amplitude rotational accelerations, while diffuse axonal injuries occur in the case of longer and more widespread acceleration loads. In addition, rotational injuries can include less severe injuries such as concussion.

The head has natural protective systems adapted to dampen these forces, using the scalp, the hard skull and the cerebrospinal fluid between the skull and the brain. During an impact, the scalp and cerebrospinal fluid acts as a rotational shock absorber by both compressing and sliding over and under the skull, respectively.

It is has therefore previously been proposed to provide a helmet that mimics to an extent the function of the scalp and cerebrospinal fluid by providing a slidable layer within the helmet such that, during an oblique impact, the outer surface of the helmet can rotate relative to the head of the wearer.

However, providing such a sliding layer within the structure of a helmet can be difficult and/or expensive to provide. Furthermore, many individuals may already own a helmet without such a sliding layer and may not wish to purchase a new helmet.

According to the present invention, there is provided a hat formed from any one of the materials discussed above. Such a hat may be worn between a wearer's head and a helmet, creating a slidable layer between the head and the helmet. This may reduce the extent and/or likelihood of injury in the event of an oblique impact on the helmet. For example some rotational energy may be absorbed and/or some of the energy of the oblique impact may be redirected into translational energy rather than rotational energy. By use of such a hat, a pre-existing helmet may be upgraded to include the protection provided by such a slidable layer. In the case of a helmet that is already equipped with a slidable layer, the wearing of a hat formed from the materials discussed above in conjunction with the helmet may enhance the protection against rotational injuries.

It should be appreciated that a hat according to the present invention, namely one formed from the material discussed above, may be used in conjunction with any form of helmet. For example, the hat may be used in conjunction with at least a cycling helmet, a motor cycling helmet, a motor-car racing helmet, a horse riding helmet, a skiing helmet, a snowboarding helmet, a skating helmet, an ice hockey helmet, a lacross helmet, a climbing helmet, a skateboarding helmet, an American football helmet, a baseball helmet, an airsoft helmet, a paintballing helmet, a cricket helmet and/or a helmet that may be designed for any other specific purpose.

It should be realised that the hat including the material discussed above may be worn without the use of conventional helmet and provide some protection against injuries. In particular, as discussed above, the material may include one or more layers of padding which, in combination with the sliding layer, may provide beneficial protection from oblique impacts. For example, a hat formed from a material of the present invention in combination with padding may be used to provide a so-called scrum cap that may be worn by players playing sports such as rugby union. A hat formed of material of the present invention may also form the basis of headgear for golf. Other uses are also possible.

Figure 4:
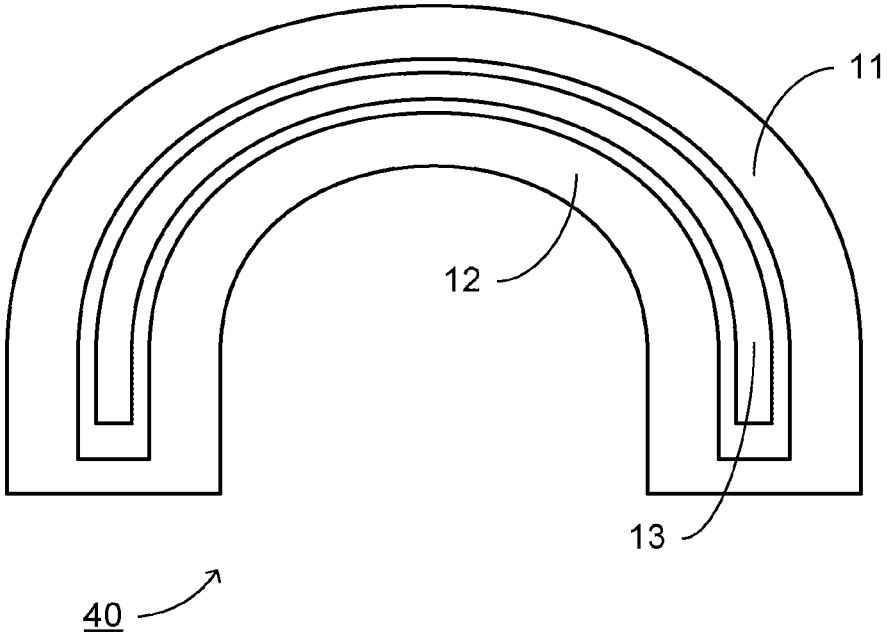
FIG. 4 depicts a cross-section of a hat formed according to the present invention.

FIG. 4 schematically depicts a hat according to the present invention. As shown, it may have a simple shape to match the shape of the top of the skull, similar to a so-called beanie. In the example shown in FIG. 4, the hat 40 is formed from the material discussed above in relation to FIG. 1, namely is formed from first and second layers of material 11, 12 and includes a third layer of material 13, arranged between the first and second layers of material 11, 12, and formed from material selected such that there is low friction between the third layer of material 13 and at least one of the first and second layers of material 11, 12. During an impact, either directly on the first layer of material 11 or transmitted to the first layer of material 11 via a helmet worn outside the hat 40, the first layer of material 11 may slide relative to the second layer of material 12. This may enable sliding of the first layer of material 11 and the helmet, where worn, relative to the head of the wearer reducing the likelihood and/or extent of rotational injuries.

It should be appreciated that any of the other materials discussed above could be used to form a hat according to the present invention.

As discussed above, the material may be configured to include perforations and/or ventilation holes. In general, the hat may be configured, by use of such perforations and/or ventilation holes and/or by selection of the substances used to form the material, to ensure that heat and/or sweat can be transferred away from the head of the wearer.

As discussed above, at least one of the first and second layers of the material may be selected to be stretchable, which may help in ensuring that a region of the first layer of material can slide relative to the second layer of material. Use of such material may also ensure that the hat 40 overall is stretchable and thereby may provide a comfortable but secure fit to a variety of head sizes.

In an arrangement, the material used to form the hat 40 may have a total thickness of from 0.1 mm to 20 mm.

Depending on the selection of materials and the detailed configuration, a hat according to the present invention may enable considerable sliding of one layer of the hat relative to another layer of the hat. In the context of an adult sized head, this may enable sliding of a region of one layer of the hat relative to the other layer of up to 100 mm.

It should be appreciated that a hat according to the present invention may have different shapes from that depicted in FIG. 4. In particular, it may be desirable to remove one or more regions of the hat. For example, it may not be necessary to provide a hat that is in contact with the entirety of the top of the skull of the wearer whilst still enabling sliding of a helmet worn outside the hat. In that case, the top portion of the hat, or another portion, may be omitted in order to increase ventilation to the head. According to an aspect of the invention, the extent of the hat may be sufficiently reduced that it is, in effect, a head band.

Figure 5:
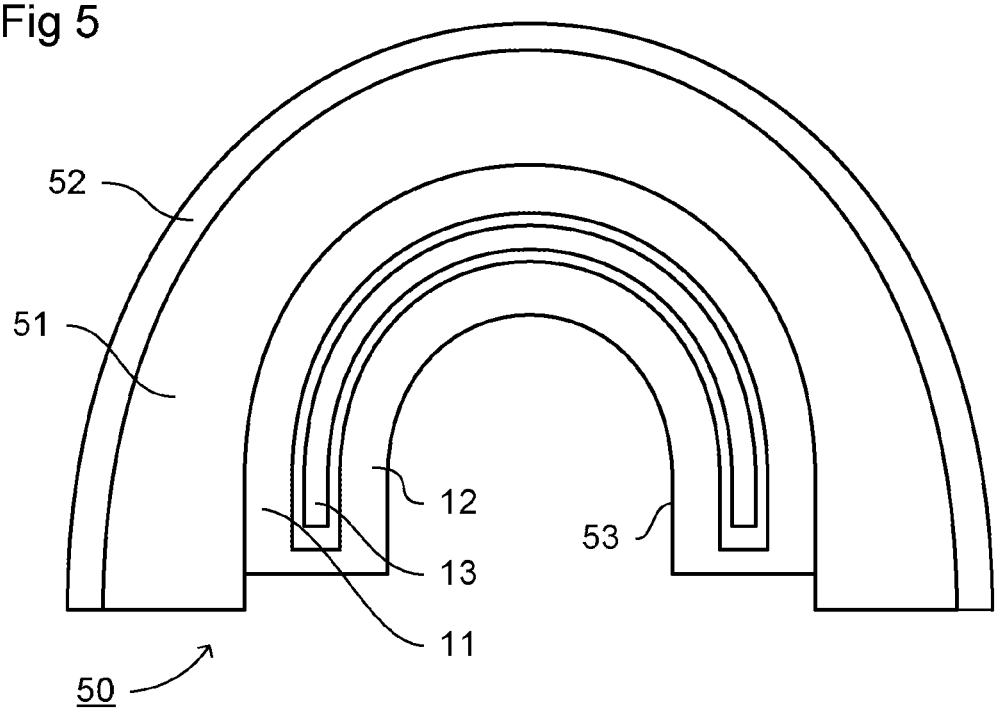
FIG. 5 depicts a cross-section of a helmet including a liner formed according to the present invention.

According to an aspect of the invention, the material discussed above may be used to form a liner that is part of a helmet. Such an arrangement is schematically depicted in FIG. 5. In the arrangement shown, the liner 53 is formed from a material as described above with reference to FIG. 1. Accordingly, it includes first and second layers of material 11,12 with a third layer of material 13 formed between them, selected such that there is low friction between the third layer of material 13 and at least one of the first and second layers of material 11, 12. It should be appreciated that any of the other materials described above may also be used to form the liner 53.

As shown, the liner 53 may be provided within a helmet formed from, for example, a foam layer 51 that is configured to absorb energy from radial impact, surrounded by a rigid shell 52. Other conventional helmet arrangements may also be used in conjunction with such a liner 53 of the present invention.

As will be appreciated, the use of the material of the present invention to provide a liner 53 within a helmet 50 may provide a relatively simple way to introduce a slidable layer to an existing helmet design.

According to an aspect of this invention, the liner 53 may be detachable from the foam layer 51. For example, the liner 53 may be secured by hook and eye fasteners that secure the first layer of material 11 to the foam layer 51. This may enable the liner 53 to be easily removed, for example, to be washed periodically and/to be replaced.

The invention claimed is:

1. A helmet, comprising a liner formed from a material comprising:

first and second layers of material; and a low friction interface arranged between the layers to enable sliding of the first layer of material relative to the second layer of material;

wherein at least one of the first and second layers of material are formed from a material that is at least one of a textile, a cloth, a fabric or a felt; and the at least one of the first and second layers of material is flexible.

2. A helmet according to claim 1, wherein the at least one of the first and second layers of material is stretchable.

3. A helmet according to claim 1, wherein at least one of the first and second layers of material is adjacent to the low friction interface.

4. A helmet according to claim 1, wherein the low friction interface is formed by at least one of the first and second layers of material.

5. A helmet according to claim 1, wherein the at least one of the first and second layers of material is are formed substantially only from the at least one of the textile, the cloth, the fabric or the felt.

6. A helmet according to claim 1, wherein the low friction interface comprises a third layer of material, arranged between the first and second layers of material and formed from material selected such that there is low friction between the third layer of material and at least one of the first and second layers of material.

7. A helmet according to claim 1, wherein low friction interface comprises third and fourth layers of material, arranged adjacent each other between the first and second layers of material, and each formed from material selected such that there is low friction at least between the third and fourth layers of material.

8. A helmet according to claim 1, wherein the low friction interface comprises a modification of the surface of at least one of the first and second layers such that there is low friction between that surface and an adjacent layer.

9. A helmet according to claim 8, wherein said modification of the surface comprises the use of a different substance from that used to form the first or second layer of material, impregnated into the surface of the first or second layer of material or bonded to the first or second layer of material.

10. A helmet according to claim 8, wherein said modification of the surface comprises a physical treatment to the surface of at least one of the first and second layers in order to change the mechanical properties of the surface of the material.

11. A helmet according to claim 1, wherein the low friction interface is configured such that, under loading that may be expected for apparel being worn by a wearer, the first layer of material may slide relative to the second layer of material.

12. A helmet according to claim 11, wherein the hat or headband is configured to provide protection to a wearer during an impact; and the low friction interface is configured such that, during an impact that is expected to be survivable for the wearer, the first layer of material may slide relative to the second layer of material.

13. A helmet according to claim 1, wherein at least one of the first and second layers of material comprises padding.

14. A helmet according to claim 1, wherein at least one of the layers is perforated.

* * * * *